US006309557B1

(12) United States Patent
Ooido et al.

(10) Patent No.: US 6,309,557 B1
(45) Date of Patent: Oct. 30, 2001

(54) MAGNETIC GARNET MATERIAL AND FARADAY ROTATOR USING THE SAME

(75) Inventors: Atsushi Ooido; Kazuhito Yamasawa; Masanori Goto; Shinji Iwatsuka, all of Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 09/511,715

(22) Filed: Feb. 23, 2000

(30) Foreign Application Priority Data

Mar. 15, 1999 (JP) ..... 11-068832

(51) Int. Cl.[7] ..... H01F 1/34

(52) U.S. Cl. ..... 252/62.57; 428/694 GT; 428/900; 428/228; 428/701; 117/945; 359/280; 359/281; 359/282; 359/283; 359/284

(58) Field of Search ..... 252/62.57; 117/945; 359/280, 281, 282, 283, 284; 428/694 GT, 701, 900, 228

(56) References Cited

U.S. PATENT DOCUMENTS 4,698,281 * 10/1987 Armand et al. ..... 252/62.57
5,512,193 * 4/1996 Shirai et al. ..... 252/62.57

FOREIGN PATENT DOCUMENTS 63-069718 3/1988 (JP) .
09-033870 2/1997 (JP) .
A-9-236784 9/1997 (JP) .

* cited by examiner

*Primary Examiner*—C. Melissa Koslow
(74) *Attorney, Agent, or Firm*—Oliff & Berridge, PLC

(57) ABSTRACT

An object is to provide a magnetic garnet material, even if a thickness of an element is made thin, in which a sufficient Faraday rotation capacity can be obtained, a magnetic field for saturation can be controlled to be less than 200 (Oe), and a magnetic compensation temperature can be controlled to be less than 0° C. as well as to provide a Faraday rotator which can be made thin, suppresses a manufacturing cost and achieves a high yielding. The above object can be achieved by a magnetic garnet material known as the general chemical formula $Bi_xYb_yGd_zM1_{3-x-y-z}Fe_wM2_uM3_{5-w-u}O_{12}$ and the Faraday rotator using the above material. However, M1 is more than one kind of chemical elements which can replace Bi, Yb or Gd, M2 is more than one kind of non-magnetic chemical elements which can replace Fe, and M3 is more than one kind of chemical elements which can replace Fe and M2. Further, x, y, z, w and u respectively satisfies $1.0 \leqq x \leqq 1.6$, $0.3 \leqq y \leqq 0.7$, $0.9 \leqq z \leqq 1.6$, $4.0 \leqq w \leqq 4.3$ and $0.7 \leqq u \leqq 1.0$.

2 Claims, No Drawings

MAGNETIC GARNET MATERIAL AND FARADAY ROTATOR USING THE SAME

BACKGROUND OF THE INVENTION

1. Field of the Invention

The present invention relates to a magnetic garnet material and a Faraday rotator which utilizes the magneto-optical effect using the magnetic garnet material. It will be noted that the Faraday rotator according to the present invention is used, for example, in an optical isolator or an optical attenuator.

2. Description of the Related Art

In optical communication or optical application equipment using semiconductor laser, an optical isolator, an optical circulator or an optical attenuator is widely used. A Faraday rotator can be cited as one of the essential elements for these devices.

Although a single crystal of YIG (yttrium iron garnet) and a bismuth substituted rare earth iron garnet single crystal are known as the material for the Faraday rotator, the Faraday rotator using a single crystal film of rare earth garnet replaced with bismuth formed by a liquid phase epitaxial method (hereinafter referred to as an LPE method) is the mainstream device, at present.

For example, a type of bismuth substituted rare earth iron garnet in which a general chemical formula is $(Bi_xRe_y Gd_{5-x-y})\ Fe_5O_{12}$, Re is Lu or Yb or both Lu and Yb, and is $0.5 \leqq x \leqq 1.3$, $0.1 \leqq y \leqq 0.7$, is disclosed in the publication of Japanese Laid Open Patent Application No. 63-69718. Further, the type of bismuth substituted rare earth iron garnet in which a general chemical formula is $Gd_{3-x}Bi_xFe_{5-y-z} Ga_yAl_zO_{12}$ (here, $0.90 \leqq x \leqq 1.05$, $0.50 \leqq y \leqq +z \leqq 0.65$, $0.20 \leqq y/z \leqq 0.27$) is disclosed in the publication of Japanese Laid Open Patent Application No. 9-33870. Furthermore, recently miniaturization of the device for the optical isolator and the like and the optical attenuator using a magnetic optical element as disclosed in the publication of Japanese Laid Open Patent Application No. 9-236784 are focused, thereby increasing the requirement of the Faraday rotator which saturates in a low magnetic field.

The Faraday rotator which saturates in the low magnetic field can be easily obtained by replacing an Fe element with a non-magnetic element such as Ga, Al, etc. and, in fact, some have been proposed.

However, when the Fe element is replaced with a non-magnetic element, a Faraday rotational capacity reduces, thereby resulting in a defect that the thickness of the element must be made thick. The thickness of the element for the Faraday rotator in which the magnetic field required for saturation is less than 200 (Oe) needs to be approximately 500 $\mu$m in the case of the Faraday rotator for the optical isolator working at the wavelength of 1550 nm, and 1000–1200 $\mu$m for the optical attenuator working at the wavelength of 1550 nm. Further, when an amount of the non-magnetic element increases, a magnetic compensation temperature becomes above 0° C., thereby resulting in a problem that a temperature range for using the Faraday rotator is limited.

When forming the single crystal film of magnetic garnet according to the LPE method, cracks easily occur during film growth because heat expansion coefficients for a substrate material such as a single crystal of gadolinium-gallium-garnet (hereinafter referred to as GGG) with additives of Ca, Zr and Mg and for a single crystal film of magnetic garnet differ by approximately 20%. Although the tendency becomes particularly prominent when the thickness is more than 500 $\mu$m and efforts to avoid the cracks are made by various methods, reducing the thickness of the element is one of the most effective methods.

Since in the LPE method, a solid phase is separated from a liquid phase in a supersaturated state to a substrate for epitaxial growth, the LPE method always contains a possibility to separate the solid phase other than an epitaxial film. When such a solid phase is separated, a problem of crack occurring to a surface of the epitaxial film or a considerable reduction in growth rate is caused. Since when the thickness of the film exceeds 500 $\mu$m, the time to be exposed in the supersaturated state reaches several tens of hours, this problem is easily produced.

Further, when the Faraday rotator is obtained from the formed single crystal film of magnetic garnet, a film thicker more than approximately 100 $\mu$m than the thickness of the element is required for performing a substrate elimination or surface polishing. Therefore, the above problems become more and more prominent.

Thus, when the thickness of the element becomes thick, not only miniaturization of the device is exerted an evil influence, but also cracks at formation of the single crystal film, an occurrence of a surface defect and remarkable reduction in growth rate are produced, thereby causing a reduction in yield, an increase in cost, and a reduction in productivity. Also, a situation arises to require a plurality of materials to make one rotator, thereby further increasing the cost.

For example, in the case of the rotator for the optical attenuator, wavelength is 1550 nm and the thickness of the element is equal to approximately 1–1.2 mm. Therefore, the single crystal film of magnetic garnet is required to be approximately 1.1–1.3 mm in thickness. Three pieces must be layered to be used as the material, thereby causing a problem of an increase in cost and complexity in handling.

SUMMARY OF THE INVENTION

An object of the present invention is to provide a magnetic garnet material, in which a sufficient Faraday rotational capacity can be obtained even when the thickness of the element is reduced, in which the magnetic field required for saturation is 200 (Oe) or less and the magnetic compensation temperature of which can be less than 0° C.

Further object of the present invention is to provide the magnetic garnet material, which does not easily cause surface defects to occur and the growth rate to reduce when forming the thick film.

Furthermore object of the present invention is to offer the Faraday rotator which can reduce the thickness of the element while holding down fabrication costs and realizing high fabrication yield.

Above objects are achieved by a magnetic garnet material having a chemical composition represented by the general formula $$Bi_xYb_yGd_zM1_{3-x-y-z}Fe_wM2_uM3_{5-w-u}O_{12}$$

in which M1 is at least one element which can replace Bi, Yb or Gd, M2 is at least one non-magnetic element which can replace Fe, M3 is at least one element which can replace Fe and M2 and x, y, z, w and u satisfy $1.0 \leqq x \leqq 1.6$, $0.3 \leqq y \leqq 0.7$, $0.9 \leqq z \leqq 1.6$, $4.0 \leqq w \leqq 4.3$ and $0.7 \leqq u \leqq 1.0$ respectively.

Furthermore, the magnetic garnet material according to the present invention has a distinctive characteristic in depositing on a single crystal substrate having a garnet structure by a liquid phase epitaxial method, where the lattice constant of the garnet structure is 1.249 (nm) or more. Also, the magnetic garnet material according to the present invention has distinctive characteristics in which the magnetic field required for saturation is 200 (Oe) or less, the magnetic compensation temperature is less than 0° C. and the Faraday rotational capacity is 1000 (deg/cm) or more.

Further, the above objects can be achieved by the Faraday rotator which has a distinctive characteristic in being formed by the magnetic garnet material of the present invention.

DESCRIPTION OF THE PREFERRED EMBODIMENT

A Faraday rotational capacity of a single crystal film of magnetic garnet formed according to a composition disclosed in the present invention is 1250 deg/cm at the wavelength of 1550 μm, a thickness of a device for an optical isolator is 360 μm, and a thickness of a device for an optical attenuator is 720–840 μm, as described in the following example, thereby enabling to reduce the thickness by approximately 30%. Further, even if the single crystal film of magnetic garnet equal to 950 μm is formed by performing an epitaxial growth for approximately 70 hours, cracks, defects on a surface of the film and a prominent reduction in growth rate are hardly recognized. As a result, a Faraday rotator for both of the optical isolator and the optical attenuator can be composed of one piece.

In the single crystal film of magnetic garnet according to the present invention, when a GGG single crystal substrate (lattice constant=1.2494 (nm)) containing a least (Ca, Zr, Mg) and an NGG single crystal substrate (lattice constant=1.2504 (nm)) are used, a bismuth amount x is selected in a range between $1.0 \leqq x \leqq 1.6$. If the bismuth amount is reduced to less than 1.0, the Faraday rotational capacity reduces, so that the thickness of the device must be made thick. Further, when a consideration is given to dependencies with other y, z and u, and when an occurrence of defects on the surface at formation of a thick film and a reduction in growth rate and the like are considered, the bismuth amount x is required not to exceed 1.6 in order to make a saturation magnetic field 200 (Oe) or less. In the same way, a ytterbium amount y is decided to be $0.3 \leqq y \leqq 0.7$ and a gadolinium amount z is decided to be in a range of $0.9 \leqq z \leqq 1.6$.

Furthermore, M1 in a formula indicates an inevitable impurity and a small amount of additive, for example, Pb, Y, and other rare earth elements and the like. M1 represents at least one element which can replace Bi, Yb or Gd. M2 in the formula is at least one kind of non-magnetic elements which can replace Fe. For example, M2 is selected from Ga, Al, In, Sc, etc. or a combination of the elements above. An amount u of this non-magnetic element M2 is selected in the range of $0.7 \leqq u \leqq 1.0$. If the amount u of the non-magnetic element is made to be less than 0.7, it becomes difficult to make the saturation magnetic field 200 (Oe) or less, and on the other hand, if the amount u of the non-magnetic element exceeds 1.0, the Faraday rotational capacity reduces, thereby causing a requirement of the thicker element. Also, if the amount u of the non-magnetic element exceeds 1.0, a magnetic compensation temperature of the Faraday rotator increases. For example, when a desired operating temperature range of the Faraday rotator is between 0° C. or less and 75° C., and in order to obtain the magnetic compensation temperature less than 0° C., the amount u of the non-magnetic element is required not to exceed 1.0. It will be noted that even if a gadolinium amount z changes, the magnetic compensation temperature also changes. Therefore, at least the dependence is established between the amount u of the non-magnetic element and the gadolinium amount z is realized.

M3 indicates an inevitable impurity and a small amount of additive that are at least one kind of element which can replace Fe and M2. For example, M3 is selected from Ti, Pt, Ge, Si, etc. or a combination of the elements above.

EXAMPLE

Example 1 through Example 3 are described as a specific examples of a magnetic garnet material according to the present invention and the Faraday rotator using the above material. It will be noted that, as a specific example, a material is searched for the purposes of making the Faraday rotational capacity as large as possible and making the thickness of the element as thin as possible in the Faraday rotator which saturates in the magnetic field of 200 (Oe) or less and has the magnetic compensation temperature of 0° C. or less in the above magnetic field, as well as searching a condition that makes it difficult for a surface defect to occur and the growth rate to reduce when forming a thick film of more than 500 μm. As a result, when a composition for the single crystal film of magnetic garnet is made to be the composition described below, an epitaxial film conforming to the purposes is discovered and resulted in the invention.

Example 1

$Yb_2O_3$, $Gd_2O_3$, $Bi_2O_3$, PbO, $Fe_2O_3$, $Ga_2O_3$, $B_2O_3$ and $GeO_2$ were weighed as much as 9.209 (g), 8.471 (g), 1462.0 (g), 1177.4 (g), 231.9 (g), 37.10 (g), 58.76 (g) and 3.039 (g) respectively, placed in a crucible made of platinum, heated to 900° C., dissolved and stirred. Then, the temperature was reduced to 750° C. and a liquid phase epitaxial growth was started on the GGG single crystal substrate (lattice constant=1.2494 (nm)) containing (Ca, Zr, Mg) of 2-inch ϕ in size. After that, when the temperature was reduced for 25 hours with a temperature gradient of 0.4° C./H and a film growth was performed, the single crystal film of magnetic garnet having a film thickness of 450 μm was obtained. There was no crack and a surface had also substantially a mirror state.

After removing the single crystal film obtained in this manner from the substrate, mirror polishing was performed on a surface side and the substrate side to have the Faraday rotational angle of 45 deg at the wavelength of 1550 nm, and the Faraday rotator of 360 μm in thickness for the optical isolator was obtained. As a result of a composition analysis by a fluorescent X-ray analyzer (hereinafter referred to as FX), the composition was $Bi_{1.37}Yb_{0.67}Gd_{0.93}Pb_{0.03}Fe_{4.16}Ga_{0.81}Ge_{0.02}Pt_{0.01}O_{12}$ and were as shown in Chart 1.

Example 2

By using the same material as in the Example 1, the liquid phase epitaxial was started at 750° C. Then, the temperature was maintained for 6 hours and furthermore, the temperature was reduced for 63 hours with the temperature gradient of 0.4° C./H to perform the film growth. As a result, the single crystal film of magnetic garnet of 950 μm in film thickness was obtained. Although a few cracks were recognized at a portion of 1 mm from a peripheral portion and furthermore defects on the surface increased compared with the Example 1, neither of them was to an extent to cause a problem in element formation.

After removing the single crystal film obtained in this manner from the substrate, the film was maintained in the air for 15 hours at 1000° C. and a heat treatment was performed.

Here, when the temperature went up and down, the temperature gradient in both cases was 200° C./H. After the heat treatment, the Faraday rotator for the optical attenuator of 840 μm in thickness where the Faraday rotational angle was 105 deg at the wavelength of 1550 nm, having the characteristics shown in Chart 1, was obtained by the mirror polishing performed by 50 μm on the film surface side and a boundary side of the substrate respectively.

When an optical attenuator was formed by using this Faraday rotator and an optical attenuation amount was measured, an attenuation of 30 dB was obtained by running an electric current of 70 mA to a coil.

Example 3

$Yb_2O_3$, $Gd_2O_3$, $Bi_2O_3$, PbO, $Fe_2O_3$, $Ga_2O_3$, $Al_2O_3$, $B_2O_3$ and $TiO_2$ were weighed as much as 4.270 (g), 10.991 (g), 1044.2 (g), 833.5 (g), 143.3 (g), 10.40 (g), 5.65 (g), 41.60 (g) and 1.433 (g) respectively, placed in the crucible made of platinum, heated to 900° C., dissolved and stirred. Then, the temperature was reduced to 779° C. and a liquid phase epitaxial growth was started on the NGG single crystal substrate (lattice constant=1.2504 (nm)) of 2-inch ϕ in size. After that, when the temperature was reduced for 33 hours with the temperature gradient of 0.6° C./H to perform the film growth, the single crystal film of magnetic garnet having a film thickness of 550 μm was obtained. There was no crack and the surface had also substantially the mirror state.

After removing the single crystal film obtained in this manner from the substrate, the mirror polishing was performed on the surface side and the substrate side to have the Faraday rotational angle of 45 deg at the wavelength of 1550 nm, and the Faraday rotator of 450 μm in thickness for the optical isolator was obtained. As a result of the composition analysis by the FX, the composition was $Bi_{1.17}Yb_{0.36}Gd_{1.44}Pb_{0.03}Fe_{4.19}Ga_{0.39}Al_{0.39}Ti_{0.02}Pt_{0.01}O_{12}$ and the characteristics were as shown in Chart 1.

TABLE 1

TABLE 1

| Item | Example 1 | Example 2 | Example 3 |
|---|---|---|---|
| Faraday Rotational Capacity (deg/cm) | 1250 | 1250 | 1000 |
| Thickness of Rotator (μm) | 360 | 840 | 450 |
| Magnetic Field Required for Saturation (Oe) | 200 | 200 | 170 |
| Temperature Fluctuation Rate of Faraday Rotational Angle (%/° C.) | 0.19 | 0.19 | 0.21 |
| Magnetic Compensation Temperature (° C.) | −75 | −75 | −5 |

Magnetic Optical Characteristics of the Faraday Rotator (Measured wavelength: 1550 nm)

As described above, according to the present invention, even if the thickness of an element is reduced, a sufficient Faraday rotational capacity can be obtained and a magnetic field required for saturation can be 200 (Oe) or less as well as a magnetic compensation temperature can be 0° C. or less. Further, according to the present invention, surface detects and a reduction in growth rate become difficult to occur even when forming a thick film.

Furthermore, according to the present invention, the thickness of an element can be reduced and a fabrication cost can be kept down, thereby realizing a Faraday rotator achieving a high fabrication yield.

What is claimed is:

1. A magnetic garnet material grown on a single crystal substrate having a garnet structure with a lattice constant of 1.249 nm or more by a liquid phase epitaxial method, the magnetic garnet material having a magnetic field of 200 Oe required for a saturation, a magnetic compensation temperature of 0° C. or less, and a Faraday rotational capacity of 1,000 deg/cm or more, and represented by the general formula:

$$Bi_xYb_yGd_zM1_{3-x-y-z}Fe_wM2_uM3_{5-w-u}O_{12}$$

wherein,

M1 is at least one element that can replace Bi, Yb or Gd;

M2 is at least one non-magnetic element which can replace Fe;

M3 is at least one element which can replace Fe and M2; and x, y, z, w and u satisfy $1.0 \leqq x \leqq 1.6$, $0.3 \leqq y \leqq 0.7$, $0.9 \leqq z \leqq 1.6$, $4.0 \leqq w \leqq 4.3$ and $0.7 \leqq u \leqq 1.0$, respectively.

2. A Faraday rotator comprising the magnetic garnet material of claim 1.

* * * * *